US007925196B2

(12) United States Patent
Ohmiya et al.

(10) Patent No.: US 7,925,196 B2
(45) Date of Patent: Apr. 12, 2011

(54) IMAGE FORMING APPARATUS

(75) Inventors: Takashi Ohmiya, Nagoya (JP); Kentaro Murayama, Kasugai (JP); Tetsuya Okano, Anjo (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 611 days.

(21) Appl. No.: 12/049,420

(22) Filed: Mar. 17, 2008

(65) Prior Publication Data

US 2008/0240797 A1 Oct. 2, 2008

(30) Foreign Application Priority Data

Mar. 27, 2007 (JP) ..... 2007-082537
Feb. 20, 2008 (JP) ..... 2008-038790

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS 5,457,518 A 10/1995 Ashikaga et al.
5,600,404 A 2/1997 Ando et al.

FOREIGN PATENT DOCUMENTS

JP 06-137812 5/1994
JP 08-118737 5/1996
JP 2001-228679 8/2001
JP 2005-018094 1/2005

*Primary Examiner* — David M Gray
*Assistant Examiner* — Erika Villaluna
(74) *Attorney, Agent, or Firm* — Banner & Witcoff, Ltd.

(57) ABSTRACT

During a first operation, at least one of a first pattern and a second pattern is formed on a first area of an image carrier, and at least the other pattern is formed on a second area of the image carrier. The first area corresponds to a half of the image carrier, while the second area corresponds to the remaining half of the image carrier. During a second operation, a second pattern is formed on an area of the image carrier where a first pattern is formed during the first operation, and a first pattern is formed on an area of the image carrier where a second pattern is formed during the first operation.

8 Claims, 17 Drawing Sheets

IMAGE FORMING APPARATUS

CROSS REFERENCE TO RELATED APPLICATION

This application claims priority from Japanese Patent Application No. 2007-82537 filed on Mar. 27, 2007 and Application No. 2008-38790 filed on Feb. 20, 2008. The entire content of these priority applications is incorporated herein by reference.

TECHNICAL FIELD

The present disclosure relates to an image forming apparatus.

BACKGROUND

An image forming apparatus of a tandem type is conventionally provided, in which photoconductors are provided individually for respective colors such as black, cyan, magenta and yellow. The photoconductors are arranged along the rotational direction of a paper conveyor belt (i.e., an image carrier), so that images of respective colors held on the photoconductors can be sequentially transferred to paper on the belt.

In this type of image forming apparatus, color registration for aligning images of respective colors is important, because the resultant color image may include a color shift due to color registration errors (i.e., due to displacement of the images of respective colors). In view of this, it has been proposed that color registration errors be detected and corrected for respective colors in the image forming apparatus.

Specifically, a registration pattern (i.e., a pattern used for alignment) including a plurality of marks of respective colors such as black, cyan, magenta and yellow is formed on the belt, so that the marks of respective colors are arranged spaced apart along the rotational direction of the belt.

The positions of marks of each color on the belt, which indicate displacement of an image to be formed of the color, are detected by an optical sensor, and the displacement is corrected based on the detected positions. In this way, displacement of an image to be formed of each color is corrected in the rotational direction of the belt.

However, in some cases, displacement in the direction perpendicular to the traveling direction of the belt and parallel to the belt surface should be also corrected.

Further, the belt in itself involves displacement or movement fluctuation when rotating. That is, its displacement or movement varies depending on the areas of the belt. Therefore, the above correction depends on where the registration pattern is formed on the belt. That is, the correction may fail to be made with accuracy depending on where the registration pattern is formed.

SUMMARY

One aspect of the present invention provides an image forming apparatus that includes an image carrier capable of rotation, and a forming portion configured to form a first pattern and a second pattern on the image carrier. The first pattern is used for detecting displacement of an image forming position in the rotational direction of the image carrier. The second pattern is used for detecting displacement of an image forming position in a direction perpendicular to the rotational direction.

The image forming apparatus further includes a detecting portion configured to detect the first pattern and the second pattern formed on the image carrier, and a correcting portion configured to correct, based on a detection result from the detecting portion, an image forming position associated with the forming portion.

The forming portion performs a first operation and thereafter performs a second operation. At least one of the first pattern and the second pattern is formed on a first area of the image carrier during the first operation, and at least the other of the first pattern and the second pattern is formed on a second area of the image carrier during the first operation. The first area corresponds to a half of the image carrier, while the second area corresponds to the remaining half of the image carrier.

During the second operation, the first pattern is formed on an area of the image carrier where the second pattern is formed during the first operation, and the second pattern is formed on an area of the image carrier where the first pattern is formed during the first operation.

According to the present invention, during the second operation, the first pattern used for detecting displacement of an image forming position in a rotational direction (hereinafter, referred to as "a first direction") of the image carrier is formed on an area other than the area where the first pattern is formed during the first operation. Further, during the second operation, the second pattern used for detecting displacement of the image forming position in a direction (hereinafter, referred to as "a second direction") perpendicular to the first direction is formed on an area other than the area where the second pattern is formed during the first operation. Thereby, the effect of movement fluctuation of the image carrier can be suppressed, compared to a construction in which the first or second pattern is formed on the same area during the first and second operations.

Further, in the second operation, the area where the first pattern is formed during the first operation and the area where the second pattern is formed during the first operation are exchanged. According to this construction, displacement correction of the image forming position in the first and second directions can be achieved substantially with the same accuracy.

BRIEF DESCRIPTION OF THE DRAWINGS

Illustrative aspects in accordance with the present invention will be described in detail with reference to the following drawings wherein.

DETAILED DESCRIPTION

Illustrative Aspect

An illustrative aspect of the present invention will be explained with reference to FIGS. 1 through 7.

(General Construction of Printer)

Figure 1:
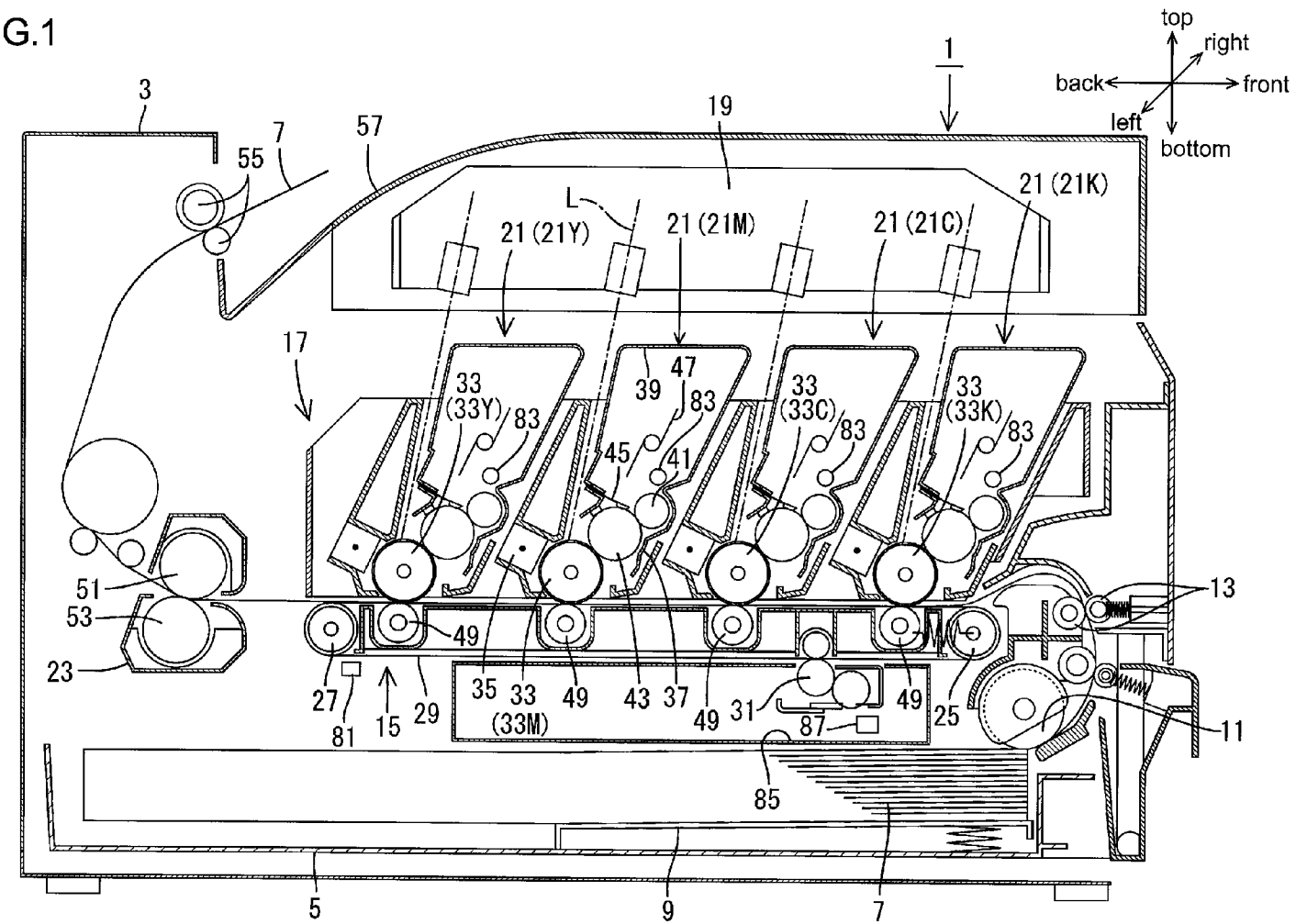
FIG. 1 is a schematic side sectional view of a printer according to an illustrative aspect of the present invention.

FIG. 1 is a schematic sectional side view of a printer 1 according to the present aspect. Hereinafter, the right side of FIG. 1 is referred to as the front side of the printer 1.

The printer 1 (i.e., an example of "an image forming apparatus" of the present invention) is a color laser printer of a direct-transfer tandem type, which has a casing 3 as shown in FIG. 1. A feeder tray 5 is provided on the bottom of the casing 3, and recording media 7 (i.e., sheets such as paper) are stacked on the feeder tray 5.

The recording media 7 are pressed against a pickup roller 11 by a platen 9. The pickup roller 11 forwards the top one of the recording media 7 to registration rollers 13, which forward the recording medium 7 to a belt unit 15 at a predetermined time. If the recording medium 7 is obliquely directed, it is corrected by the registration rollers 13 before forwarded to the belt unit 15.

An image forming section 17 includes the belt unit 15 (as an example of a conveyor means), a scanner unit 19 (as an example of an exposure means), processing units 21, a fixation unit 23 and the like. In the present aspect, the scanner unit 19 and the processing units 21 function as "a forming portion" of the present invention.

The belt unit 15 includes an endless belt 29 (as an example of "an image carrier" of the present invention), which is disposed between a pair of support rollers 25, 27 (as an example of a transferring mechanism). The belt 29 is driven by rotation of the backside support roller 27, for example. Thereby, the belt 29 rotates in anticlockwise direction in FIG. 1, so as to convey the recording medium 7 (forwarded thereto) backward.

A cleaning roller 31 (as an example of "a collecting portion" of the present invention) is provided below the belt unit 15, in order to remove toner (including registration patterns 91A, 91B described below), paper dust and the like, which can become attached to the belt 29.

The scanner unit 19 includes laser emitting portions (not shown), which are controlled based on image data of the respective colors so as to switch between ON and OFF. Thereby, the scanner unit 19 performs fast scan by radiating laser beams L from the laser emitting portions to the surfaces of photosensitive drums 33. The photosensitive drums 33 are individually provided for the respective colors as described below, and laser beams L based on image data of each color is radiated to the corresponding photosensitive drum 33.

The processing units 21 are provided for the respective colors, i.e., black, cyan, magenta and yellow. The processing units 21 have the same construction, but differ in color of toner (as an example of "a colorant" of the present invention). Each processing unit 21 includes a photosensitive drum 33 (as an example of a photoconductor), a charger 35, a developer cartridge 37 and the like.

The developer cartridge 37 includes a toner container 39, a supply roller 41, a developer roller 43 and a layer thickness controlling blade 45 (as an example of a layer thickness control means).

Toner is supplied to the developer roller 43 by rotation of an agitator 47 (as an example of an agitation means) and the supply roller 41. The toner on the developer roller 43 enters between the layer thickness controlling blade 45 and the developer roller 43, so as to be held as a thin layer of a predetermined thickness on the developer roller 43.

The surface of the photosensitive drum 33 for each color is charged homogeneously and positively by the charger 35, and thereafter exposed to laser beams L from the scanner unit 19 as described above. Thereby, an electrostatic latent image (corresponding to an image of the color to be formed on the recording medium 7) is formed on the surface of the photosensitive drum 33.

Next, the toner on the developer roller 43 is supplied to the surface of the photosensitive drum 33 so as to adhere to the electrostatic latent image. Thus, the electrostatic latent image of each color is visualized as a toner image of the color on the photosensitive drum 33.

While the recording medium 7 (being conveyed by the belt 29) passes between each photosensitive drum 33 and the corresponding transfer roller 49 (as an example of a transfer means), a negative transfer bias is applied to the transfer roller 49. Thereby, the toner images on the respective photosensitive drums 33 are sequentially transferred to the recording medium 7, which is then forwarded to the fixation unit 23.

Using a heating roller 51 and a pressure roller 53, the fixation unit 23 heats the recording medium 7 that has the resultant toner image, while forwarding it. Thereby, the toner image is thermally fixed to the recording medium 7. After passing through the fixation unit 23, the recording medium 7 is ejected onto a catch tray 57 by discharge rollers 55.

In the printer 1, an optical sensor 81 is provided below the backside portion of the belt unit 15 as shown in FIG. 1. The optical sensor 81 is a reflective sensor that includes a light emitting section and a light receiving section. The light emitting section radiates light obliquely to the surface of the belt 29. The light receiving section receives the light reflected by the surface of the belt 29, and thereby outputs a binary signal that indicates whether any mark 93, 95 of the registration pattern 91 (described below) is present in an area of the belt 29 corresponding to the radiation range of the light emitting section.

The printer 1 further includes a first toner sensor 83 in each processing unit 21, in order to detect the remaining amount of toner in the toner container 39 of the processing unit 21. Specifically, a window (not shown) capable of light transmission is formed on the toner container 39, and the light emitting section of the first toner sensor 83 is disposed on the opposite side of the window from the light receiving section thereof. Thereby, the first toner sensor 83 can output a signal corresponding to the remaining amount of toner in the toner container 39.

In the printer 1, a second toner sensor 87 is further provided for detecting the collected amount of toner in a collection box 85 (i.e., the amount of toner collected by the cleaning roller 31). Specifically, a window is formed on the collection box 85, and the light emitting section of the second toner sensor 87 is disposed on the opposite side of the window from the light receiving section thereof. Thereby, the second toner sensor 87 can output a signal corresponding to the collected amount of toner in the collection box 85.

(Electrical Configuration of Printer)

Figure 2:
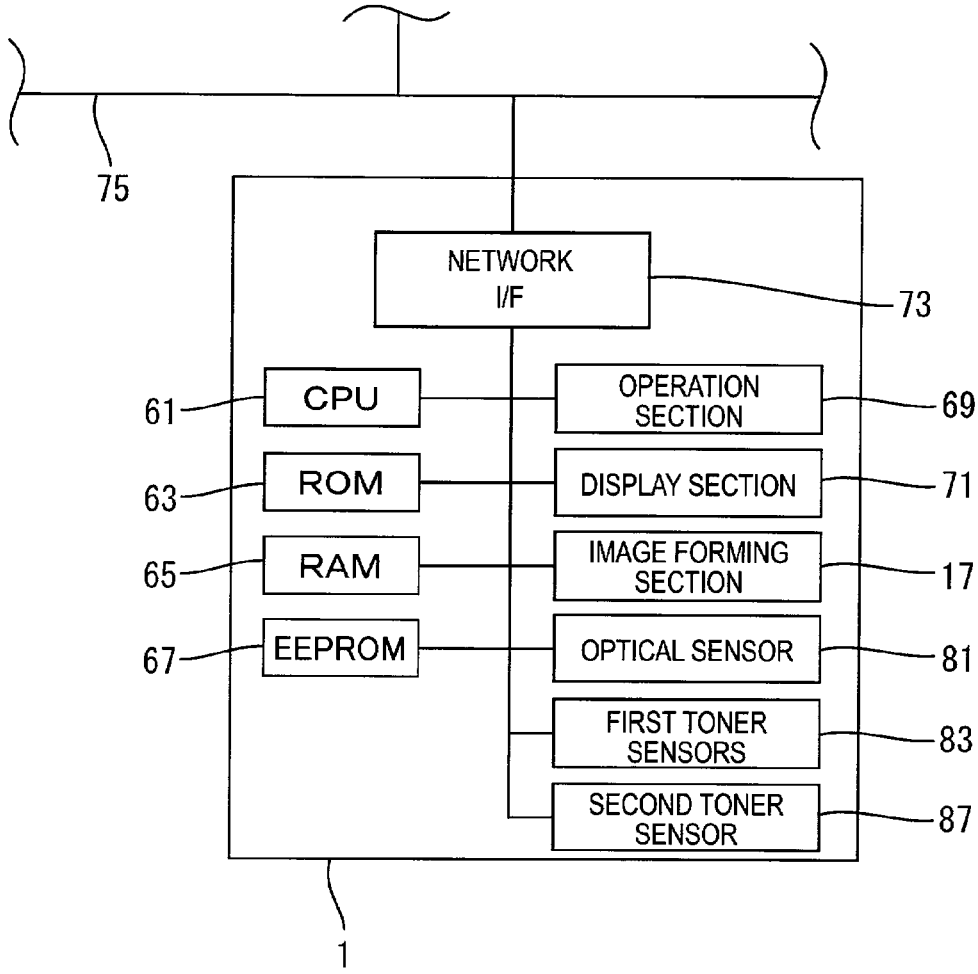
FIG. 2 is a block diagram showing an electrical configuration of the printer.

FIG. 2 is a block diagram showing the electrical configuration of the printer 1. The printer 1 includes a CPU 61, a ROM 63, a RAM 65, an EEPROM (a nonvolatile memory) 67, an operation section 69, a display section 71, the above-described image forming section 17, a network interface 73, the optical sensor 81 and the like.

Various programs for controlling the operation of the printer 1 are stored in the ROM 63. The CPU 61 controls the operation of the printer 1 based on the programs retrieved from the ROM 63, while storing the processing results in the RAM 65 and/or the EEPROM 67.

The operation section 69 includes a plurality of buttons. Thereby, a user can perform various input operations, such as an operation for a printing request. The display section 71 can include a liquid-crystal display and indicator lamps. Thereby, various setting screens, the operating condition and the like can be displayed. The network interface 73 is connected to an external computer (not shown) or the like, via a communication line 75, in order to enable mutual data communication.

(Color Registration Error Correction)

Color registration is important for the printer 1. This is because a resultant color image may include a color shift if images of respective colors transferred to the recording medium 7 fail to be aligned due to color registration errors. Therefore, color registration error correction (i.e., displacement correction) is performed in order to prevent a color shift.

Figure 3A:
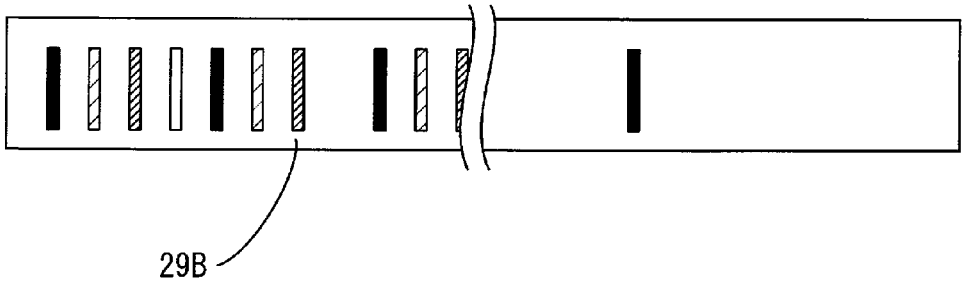
FIG. 3A is a schematic top view of a belt after one revolution during a first operation.
Figure 3B:
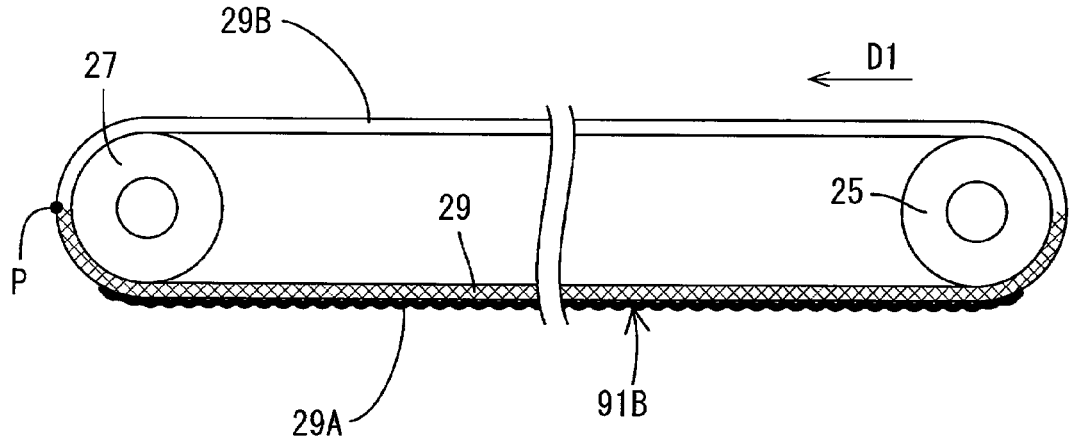
FIG. 3B is a schematic side view of the belt after one revolution during the first operation.
Figure 3C:
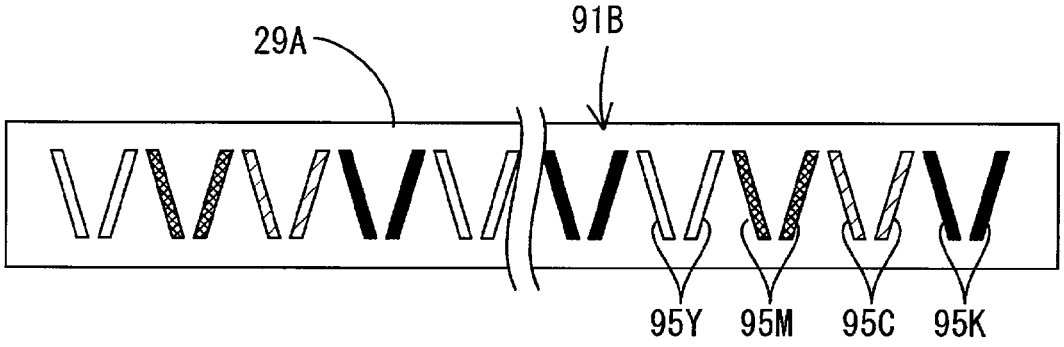
FIG. 3C is a schematic bottom view of the belt after one revolution during the first operation.
Figure 4A:
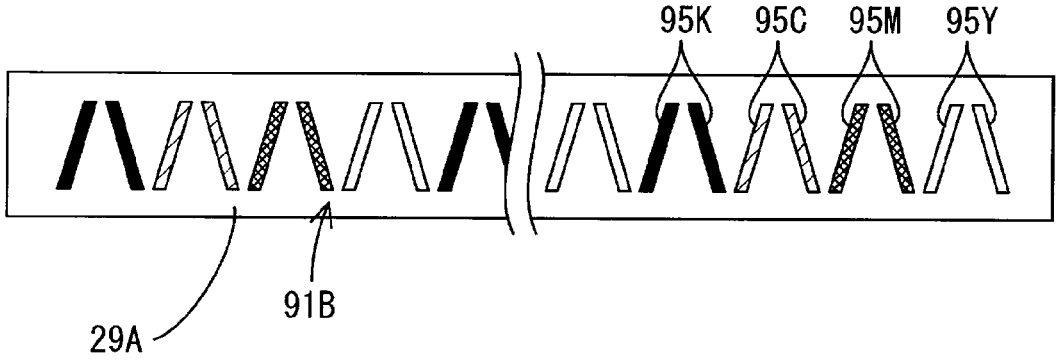
FIG. 4A is a schematic top view of the belt when the first operation is completed.
Figure 4B:
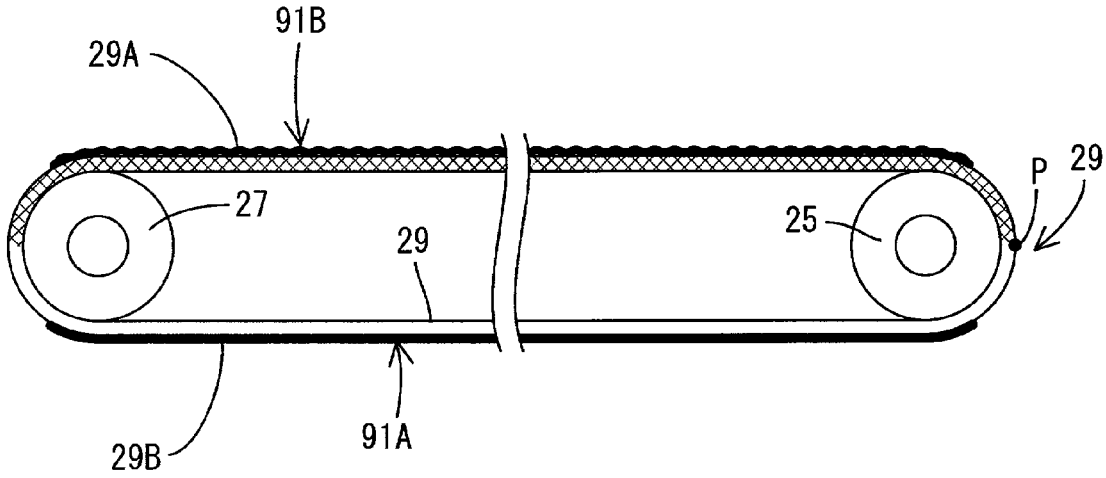
FIG. 4B is a schematic side view of the belt when the first operation is completed.
Figure 4C:
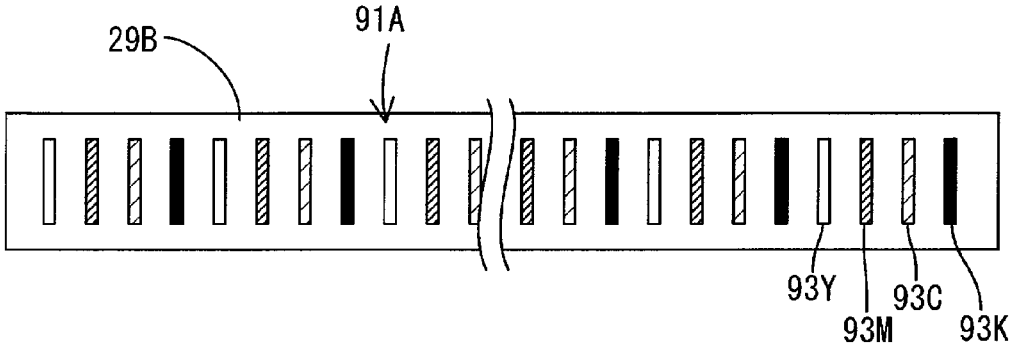
FIG. 4C is a schematic bottom view of the belt when the first operation is completed.

The color registration error correction involves a first operation and a second operation, as described below. FIGS. 3A to 3C are top, side and bottom views of the belt 29, respectively, after one revolution during the first operation. FIGS. 4A to 4C are top, side and bottom views of the belt 29, respectively, when the first operation is completed.

Figure 5A:
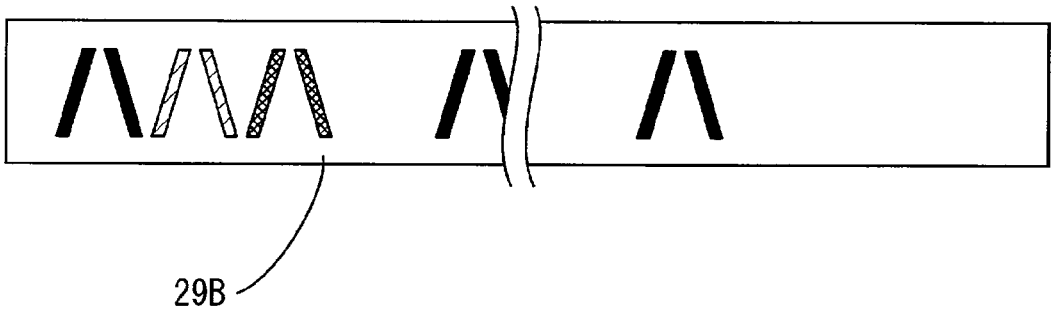
FIG. 5A is a schematic top view of the belt after one revolution during a second operation.
Figure 5B:
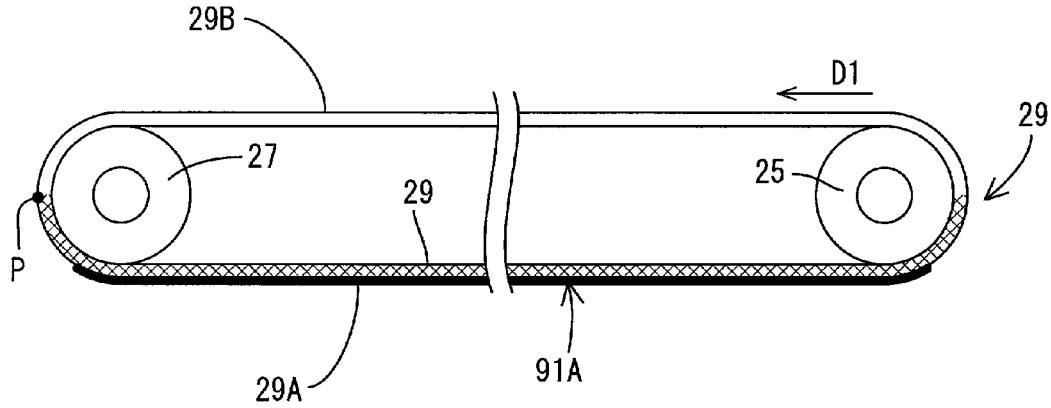
FIG. 5B is a schematic side view of the belt after one revolution during the second operation.
Figure 5C:
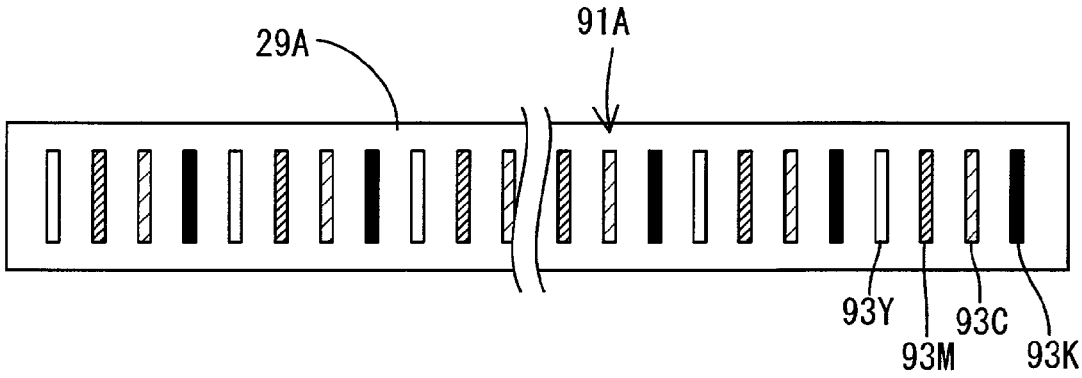
FIG. 5C is a schematic bottom view of the belt after one revolution during the second operation.
Figure 6A:
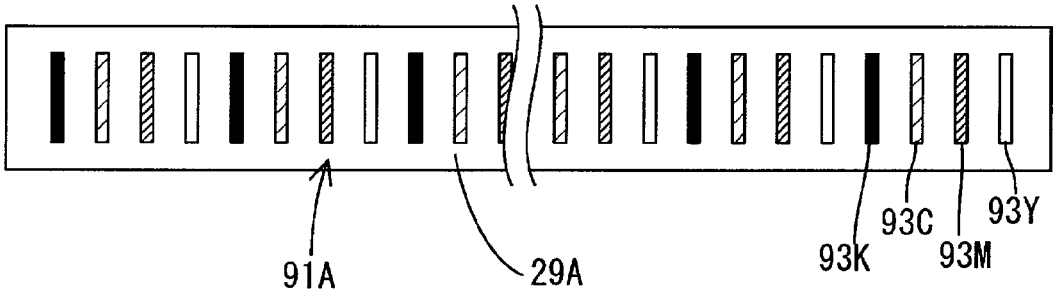
FIG. 6A is a schematic top view of the belt when the second operation is completed.
Figure 6B:
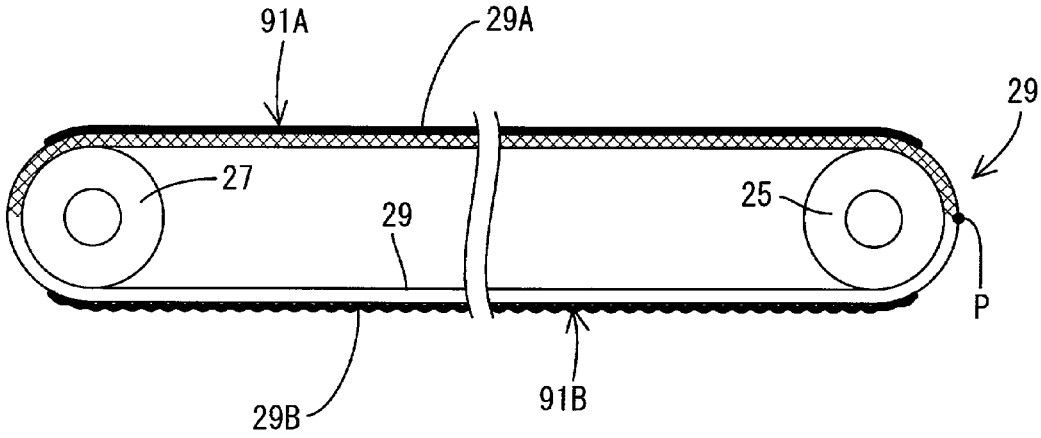
FIG. 6B is a schematic side view of the belt when the second operation is completed.
Figure 6C:
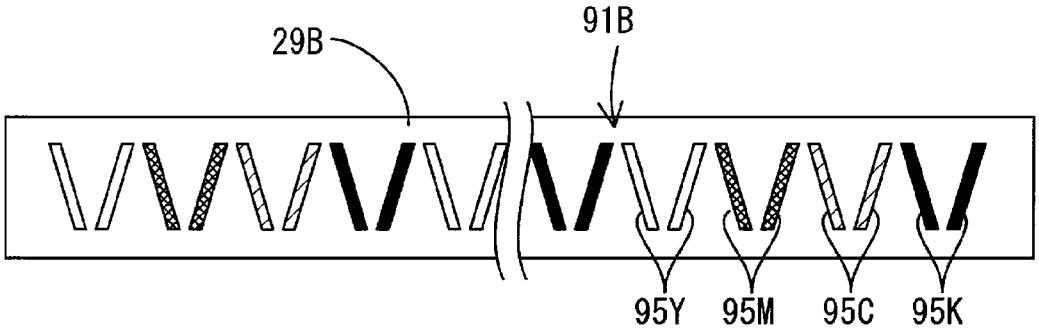
FIG. 6C is a schematic bottom view of the belt when the second operation is completed.

FIGS. 5A to 5C are top, side and bottom views of the belt 29, respectively, after one revolution during the second operation. FIG. 6A to 6C are top, side and bottom views of the belt 29, respectively, when the second operation is completed.

1. Registration Patterns

A first registration pattern (hereinafter, referred to as "a first pattern 91A") is shown in FIGS. 4C, 5C and 6A. The first pattern 91A is formed on the belt 29, in order to detect color registration errors in the rotational direction of the belt 29 (i.e., the front-back direction of the printer 1, and hereinafter referred to as "the secondary scanning direction D1").

Specifically, the first pattern 91A includes a plurality of bar-like marks 93, each of which extends in the right-to-left direction (i.e., in the vertical direction in FIGS. 4C, 5C and 6A). The marks 93 are arranged along the traveling direction of the belt 29. That is, a black mark 93K, a cyan mark 93C, a magenta mark 93M and a yellow mark 93Y are arranged in this order, so as to form a mark group. One mark group or a plurality of mark groups are arranged along the secondary scanning direction D1.

A second registration pattern (hereinafter, referred to as "a second pattern 91B") is shown in FIGS. 3C, 4A and 6C. The second pattern 91B is formed on the belt 29 in order to detect color registration errors in the direction perpendicular to the secondary scanning direction D1 and parallel to the belt surface (i.e., the right-to-left direction of the printer 1, and hereinafter referred to as "the main scanning direction").

Specifically, the second pattern 91B includes a plurality of pairs of marks arranged along the traveling direction of the belt 29. Each pair of marks includes two bar-like marks, which form different angles with the main scanning direction from each other. The pairs of marks includes one pair or a plurality of pairs of black marks 95K, one pair or a plurality of pairs of cyan marks 95C, one pair or a plurality of pairs of magenta marks 95M and one pair or a plurality of pairs of yellow marks 95Y, which are arranged along the secondary scanning direction D1.

Hereinafter, the suffixes K (Black), C (Cyan), M (Magenta) and Y (Yellow) for indicating colors are attached to symbols of marks 93, 95 when necessary. The suffixes are omitted when not necessary. The data of the first pattern 91A and the second pattern 91B is stored in the EEPROM 67, for example.

2. Control for Color Registration Error Correction

Figure 7:
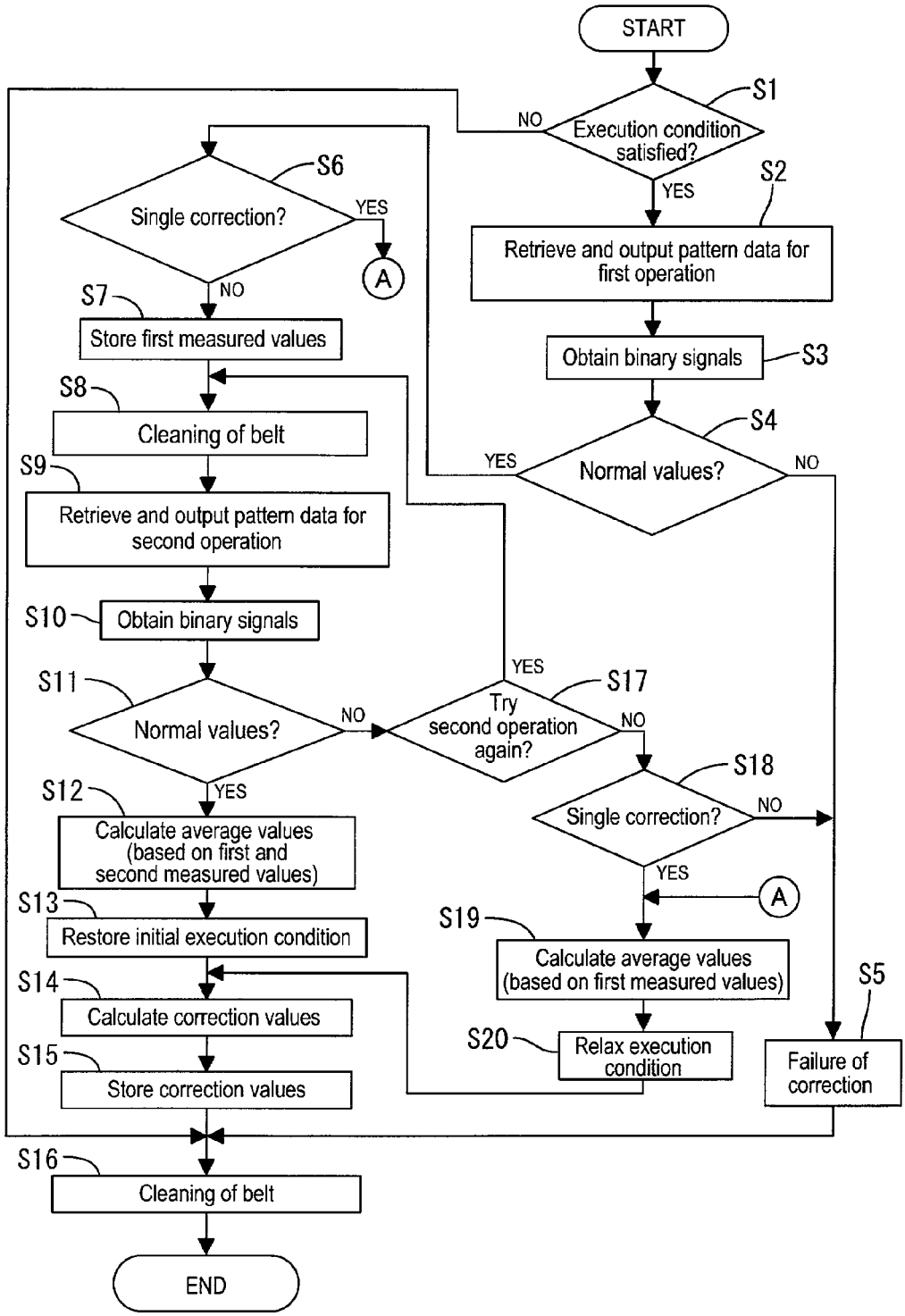
FIG. 7 is a flowchart of a displacement correction process.

The CPU 61 executes a process for color registration error correction (displacement correction) shown in FIG. 7. First, it is determined at step S1 whether an execution condition is satisfied. The execution condition is that the elapsed time or the number of printed recording media since previous execution of color registration error correction reaches a predetermined reference value, for example.

If the CPU 61 determines that the execution condition is satisfied (i.e., "Yes" is determined at step S1), the data of the second pattern 91B and the first pattern 91A is retrieved from the EEPROM 67, and provided for the image forming section 17 sequentially in this order. In response to this, the image forming section 17 performs a first operation.

The first operation involves one and a half revolutions of the belt 29. That is, the first operation is started when a reference point P of the belt 29 is on the support roller 27 side, and completed by the time the reference point P completes one and a half revolutions.

FIGS. 3A to 3C show when the belt 29 completes one revolution, while FIGS. 4A to 4C show when the belt 29 completes one and a half revolutions (i.e., when the first operation is completed). During the first operation, a second pattern 91B is formed on a first area 29A of the belt 29 as shown in FIGS. 3B and 3C, and thereafter a first pattern 91A is formed on a second area 29B of the belt 29 as shown in FIGS. 4B and 4C.

The first area 29A corresponds substantially to a half of the belt 29 originating at the reference point P, and the marks 95 of the second pattern 91B are arranged on the first area 29A to a maximum extent so that the second pattern 91B extends substantially over the entire length of the first area 29A. That is, a large number as possible of mark groups, each of which includes a pair of black marks 95K, a pair of cyan marks 95C, a pair of magenta marks 95M and a pair of yellow marks 95Y, are arranged on the first area 29A.

The second area 29B corresponds substantially to the remaining half of the belt 29, and the marks 93 of the first pattern 91A are arranged on the second area 29B to a maximum extent so that the first pattern 91A extends over the entire length of the second area 29B. That is, a large number as possible of mark groups, each of which includes a black mark 93K, a cyan mark 93C, a magenta mark 93M and a yellow mark 93Y, are arranged on the second area 29B.

At step S3, the CPU 61 obtains binary signals, which are sequentially outputted from the optical sensor 81 during the first operation. At step S4, the CPU 61 determines based on the binary signals whether measured values indicating the position of the marks 93, 95 (or indicating displacement of the cyan, magenta and yellow marks 93C, 93M, 93Y from the black marks 93K) are normal.

The measured values obtained during the first operation correspond to an example of "a first detection result" of the present invention, and are hereinafter referred to as first measured values. The CPU 61 when executing step S4 functions as "a determining portion" of the present invention.

Specifically, the CPU 61 determines that the first measured values of the positions of the marks 93, 95 are abnormal, if the pulse widths of the binary signals are much smaller or much larger than a predetermined value. This condition can occur when a noise is temporarily generated in the optical sensor 81, for example.

If it is determined that the first measured values of the positions of the marks 93, 95 are abnormal (i.e., "No" is determined at step S4), the failure of color registration error correction is determined at step S5 and indicated on the display section 71, for example. Alternatively, the process may return to step S2 so that a first operation is tried again, when "NO" is determined at step S4.

After the failure of color registration error correction is determined at step S5, the cleaning roller 31 is activated at step S16 while the belt 29 makes one or two revolutions. Thereby the first and second patterns 91A, 91B on the belt 29 are removed, and then the process terminates.

If it is determined that the first measured values of the positions of the marks 93, 95 are normal ("Yes" is determined at step S4), the CPU 61 determines at step S6 whether the condition for selecting a single correction mode is satisfied. The single correction mode is a mode for color registration error correction being performed based solely on the first measured values, and therefore a second operation can be skipped in this case.

Examples of the condition for selecting the single correction mode are as follows:

(1) A user has selected the single correction mode on the operation section 69;

(2) The user has selected, on the operation section 69, the speed-oriented mode (from the image-quality-oriented mode and the speed-oriented mode, for example);

(3) The CPU 61 has determined, based on detection signals from the first toner sensors 83, that the remaining amount of toner in any of the toner containers 39 is equal to or less than a predetermined amount (and therefore a second operation should be prevented in order to reduce toner usage for color registration error correction); and (4) The CPU 61 has determined, based on a detection signal from the second toner sensor 87, that the collected amount of toner in the collection box 85 is equal to or larger than a predetermined amount (and therefore a second operation should be prevented in order to reduce toner usage for color registration error correction and thereby prevent the collected toner amount from exceeding the collection limit of the collection box 85).

The CPU 61 may determine "Yes" at step S6, when one of the above conditions (1)-(4) is satisfied, or alternatively, when two or more of the above conditions (1)-(4) are satisfied. If "Yes" is determined at step S6, the process proceeds to step S19 so that a second operation is skipped. Thereby, toner usage can be reduced. The CPU 61 when executing step S6 functions as "a selecting portion" of the present invention.

If "No" is determined at step S6, the process proceeds to step S7 for performing a second operation. The first measured values are temporarily stored in the RAM 65 at step S7. Further, the cleaning roller 31 is activated at step S8 while the belt 29 makes one or two revolutions. Thereby, the first and second patterns 91A, 91B on the belt 29 are removed.

Next, the data of the first pattern 91A and the second pattern 91B is retrieved from the EEPROM 67 at step S9, and provided for the image forming section 17 sequentially in this order (i.e., in reverse order from the first operation). In response to this, the image forming section 17 performs a second operation.

During the second operation, the belt 29 makes one and a half revolutions in a similar manner to the first operation. That is, the second operation is started when the reference point P of the belt 29 is on the support roller 27 side, and completed by the time the reference point P completes one and a half revolutions.

The timing of the start of the second operation can be adjusted based on the values, which are preliminarily calculated based on the start time of the first operation and the set speed of the belt 29.

FIGS. 5A to 5C show when the belt 29 completes one revolution, while FIGS. 6A to 6C show when the belt 29 completes one and a half revolutions (i.e., when the second operation is completed). During the second operation, a first pattern 91A is formed on the first area 29A of the belt 29 as shown in FIGS. 5B and 5C, and thereafter a second pattern 91B is formed on the second area 29B of the belt 29 as shown in FIGS. 6B and 6C.

The marks 93 of the first pattern 91A are arranged on the first area 29A to a maximum extent so that the first pattern 91A extends substantially over the entire length of the first area 29A. The marks 95 of the second pattern 91B are arranged on the second area 29B to a maximum extent so that the second pattern 91B extends over the entire length of the second area 29B.

In this way, during the second operation, a first pattern 91A is formed on the first area 29A where a second pattern 91B is formed during the first operation, while a second pattern 91B is formed on the second area 29B where a first pattern 91A is formed during the first operation.

At step S10, the CPU 61 obtains binary signals, which are sequentially outputted from the optical sensor 81 during the second operation. It is determined at step S11 whether measured values indicating the positions of the marks 93, 95 are normal. The determination at step S11 is made in a similar manner to step S4.

The measured values obtained during the second operation correspond to an example of "a second detection result" of the present invention, and are hereinafter referred to as second measured values. The CPU 61 when executing step S11 functions as "a determining portion" of the present invention.

If it is determined at step S11 that the second measured values of the positions of the marks 93, 95 are normal, color registration error correction based on both of the first and second measured values is performed at the following steps. Hereinafter, the color registration error correction based on both of the first and second measured values is referred to as "double correction".

[Double Correction]

The double correction is performed as follows. First, at step S12, the average values of the positions of the marks 93, 95 are calculated based on the first and second measured values.

Specifically, the average value of measured values of the yellow marks 93Y, the average value of measured values of the magenta marks 93M, and the average value of measured values of the cyan marks 93C are calculated based on the first and second measured values of the first pattern 91A.

Further, the average value of measured values of the yellow marks 95Y, the average value of measured values of the magenta marks 95M, and the average value of measured values of the cyan marks 95C are calculated based on the first and second measured values (i.e., the values indicating the distances between two bar-like marks) of the second pattern 91B.

Next, correction values for correcting the positions of images of respective colors in the secondary scanning direction D1 are calculated at step S14 based on the average values which have been calculated from the measured values of the first pattern 91A. Hereinafter, the correction values for correcting displacement of image forming positions in the secondary scanning direction D1 are referred to as "first correction values".

Further, correction values for correcting the positions of images of respective colors in the main scanning direction are calculated at step S14 based on the average values which have been calculated from the measured values of the second pattern 91B. Hereinafter, the correction values for correcting displacement of image forming positions in the main scanning direction are referred to as "second correction values".

The first and second correction values are stored in the EEPROM 67 at step S15. Cleaning of the belt 29 is performed at step S16, so that the first and second patterns 91A, 91B on the belt 29 are removed. Then, the present correction process terminates.

In future operations for image formation, the positions of images of respective colors on a recording medium are corrected based on the first and second correction values stored in the EEPROM 67, so that a color shift can be prevented. Specifically, when the scanner unit 19 emits laser beams L for forming images of respective colors, timing of the emission is adjusted based on the first and second correction values so that color registration errors in the main and secondary scanning directions can be prevented.

In the present aspect, the optical sensor 81 and the CPU 61 function as "a detecting portion" of the present invention, and the CPU 61 functions as "a correcting portion" of the present invention.

If it is determined at step S11 that the second measured values of the marks 93, 95 are abnormal (i.e., "No" is determined at step S11), then it is determined at step S17 whether a second operation should be tried again.

For example, the determination at step S17 is made as follows. The failure of color registration error correction is indicated on the display section 71. As a response to the indication, the user performs an operation on the operation section 69. Whether a second operation should be tried again or not is determined based on the user's operation.

If it is determined that a second operation should be tried again (i.e., "Yes" is determined at step S17), the process returns to step S8. Thereby, a second operation is performed again after cleaning of the belt 29 is performed at step S8.

If it is determined that a second operation should not be tried again (i.e., "No" is determined at step S17), then it is determined at step S18 whether the first measured values (which have been temporarily stored in the RAM 65 at step S7) should be used for color registration error correction.

For example, the determination at step S18 is made as follows. Through the display section 71, the CPU 61 asks the user if the first measured values may be used. As a response to the inquiry, the user performs an operation on the operation section 69. Whether the first measured values should be used or not is determined based on the user's operation.

If it is determined that the first measured values should be used (i.e., "Yes" is determined at step S18), the process proceeds to steps S19 for performing correction based on the first measured values. When "Yes" is determined at step S6, the process also proceeds to step S19 as described above. Hereinafter, the correction based solely on the first measured values is referred to as "single correction".

[Single Correction]

The single correction is performed as follows. The average value of measured values of the yellow marks 93Y, the average value of measured values of the magenta marks 93M, and the average value of measured values of the cyan marks 93C are calculated at step S19 based on the first measured values of the first pattern 91A.

Further, the average value of measured values of the yellow marks 95Y, the average value of measured values of the magenta marks 95M, and the average value of measured values of the cyan marks 95C are calculated at step S19 based on the first measured values of the second pattern 91B.

Alternatively, when "Yes" is determined at step S4, the calculation of the average values based on the first measured values may be performed before step S6. In this case, the calculated average values are temporarily stored in the RAM 65 so as to be able to be retrieved at step S12 or S19.

At step S20, the execution condition used for determination at step S1 is relaxed in order to make a process of color registration error correction prone to next execution. For example, the above-described reference value for the execution condition is set to a value smaller than the initial value, so that next execution of color registration error correction is started earlier compared to when the reference value is set to the initial value. The CPU 61 (when executing step S20) functions as "a condition changing portion" of the present invention.

Note that the execution condition is restored to the initial condition at step S13 if double correction is performed during later execution of color registration error correction.

After step S20, the process proceeds to step S14. The correction values are calculated at step S14 based on the average values (calculated at step S19), and stored in the EEPROM 67 at step S15. Then, the present correction process terminates after cleaning of the belt 29 is performed at step S16. In this way, color registration error correction can be achieved if second measured values are not available.

If it is determined at step S18 that the first measured values should not be used (i.e., "No" is determined at step S18), the failure of color registration error correction is determined at step S5. Then, the present process terminates after cleaning of the belt 29 is performed at step S16.

(Effect of the Present Illustrative Aspect)

According to the present aspect, in a second operation, a first pattern 91A is formed on an area of the belt 29 other than the area where a first pattern 91A is formed during a first operation. Further, in the second operation, a second pattern 91B is formed on an area of the belt 29 other than the area where a second pattern 91B is formed during the first operation.

Thereby, the effect of movement fluctuation of the belt 29 on color registration error correction can be mitigated, compared to a construction in which a first pattern 91A and a second pattern 91B are formed on the same area of the belt 29 during the first and second operations.

Further, in the second operation, the area where the first pattern 91A is formed during the first operation and the area where the second pattern 91B is formed during the first operation are exchanged. According to this construction, color registration error correction in the main and secondary scanning directions can be achieved substantially with the same accuracy.

In the present aspect, according to the user's decision or the status of the printer 1 such as the remaining toner amount or collected toner amount, the correction mode can be switched between double correction (based on both the first and second measured values) and single correction (based solely on the first measured values). That is, according to the situation, a second operation can be skipped so that toner usage is reduced.

In the case that a second operation is performed, if the second measured values (obtained during the second operation) are abnormal (i.e., "No" is determined at step S11), color registration error correction can be rapidly achieved by using the first measured values. That is, the single correction can be selected when abnormality of the second measured values is determined, and thereby color registration error correction can be achieved without a second operation being tried again.

The double correction is superior to the single correction in accuracy, because the double correction uses a larger number of measured values. In view of this, when the single correction has been performed, the execution condition for color registration error correction is relaxed at step S20 of FIG. 7, so that next execution of color registration error correction is started earlier compared to when the double correction has been performed.

<Other Illustrative Aspects>

The present invention is not limited to the illustrative aspect explained in the above description made with reference to the drawings. The following aspects may be included in the technical scope of the present invention, for example.

(1) In the above aspect, a color laser printer of a direct-transfer type is shown as an image forming apparatus. However, the present invention can be applied to other types of image forming apparatuses such as a laser printer of an intermediate-transfer type or an ink-jet printer. Further, the present invention may be applied to a printer that uses colorants of two or three colors, or colorants of five or more colors.

The present invention is also effective for a black and white printer. If the present invention is applied to a black and white printer, an image to be formed can be accurately positioned on a recording medium.

(2) In the above aspect, the first and second patterns 91A and 91B are formed on the belt 29 (as an example of "an image carrier") that is provided for conveying recording media. However, in the case of an image forming apparatus of an intermediate-transfer type, the patterns may be formed on the intermediate transfer belt (as an example of "an image carrier") provided for intermediate transfer.

(3) In the above aspect, when abnormality of the first measured values is determined (i.e., "No" is determined at step S4 of FIG. 7), the correction process may proceed to step S8 instead of step S5. That is, a second operation may be tried if failure of the first operation is determined.

In this case, if normal measured values are obtained as second measured values during the second operation, color registration error correction can be achieved using the second measured values.

(4) In the above aspect, step S6 may be eliminated so that a second operation cannot be skipped. In this case, a second operation is necessarily performed after a first operation is normally completed. Color registration error correction can be achieved using at least one of the first and second measured values which are available as normal values.

(5) In the above aspect, as large number as possible of the marks 93, 95 of the first and second patterns 91A, 91B are arranged on the areas 29A, 29B of the belt 29. However, the marks 93, 95 do not need to be arranged to a maximum extent, but rather may be arranged so as to keep a longer distance therebetween.

Note, however, that the construction of the above aspect has the advantage that image forming positions are corrected while balancing out the effect of movement fluctuation of the belt 29 over almost the entire cycle. This results in improvement of correction accuracy.

(6) Contrary to the above aspect, during a first operation, a first pattern 91A may be first formed and thereafter a second pattern 91B may be formed. In this case, during a second operation, a second pattern 91B is first formed and thereafter a first pattern 91A is formed.

Figure 8A:
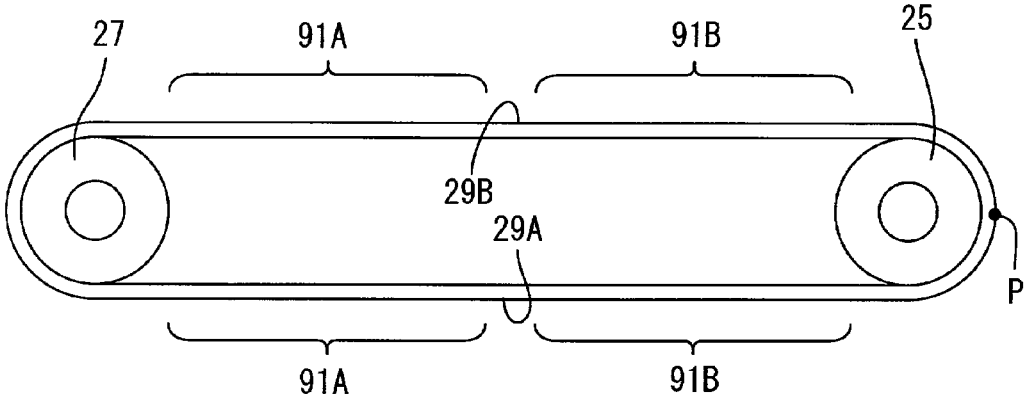
FIG. 8A is a schematic side view of the belt when a first operation is completed according to an another illustrative aspect.

(7) The patterns 91A, 91B may be formed so that each of the areas 29A, 29B includes both of the first and second patterns 91A, 91B, contrary to the above aspect. For example, during a first operation, a second pattern 91B and a first pattern 91A are first formed in this order and on the first area 29A, as shown in FIG. 8A. Thereafter, a first pattern 91A and a second pattern 91B are formed in this order and on the second area 29B.

Figure 8B:
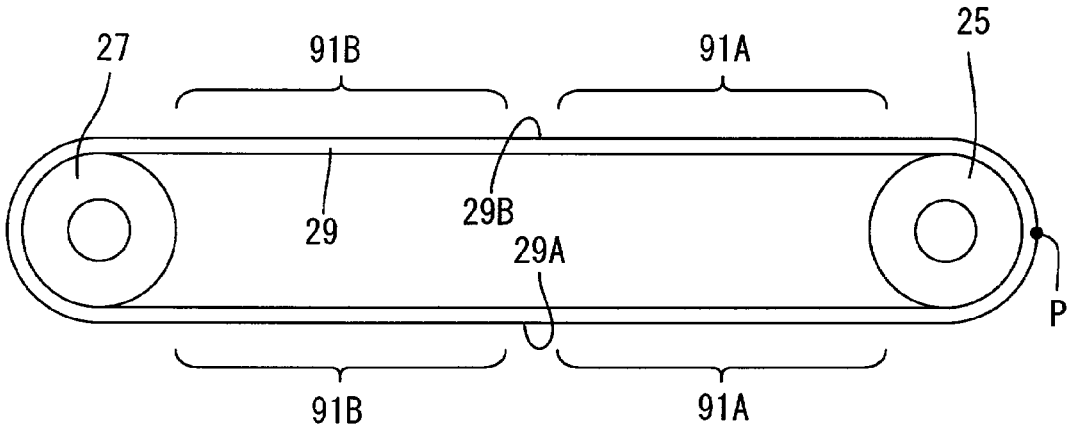
FIG. 8B is a schematic side view of the belt when a second operation is completed.

In this case, during a second operation, a first pattern 91A and a second pattern 91B are first formed in this order and on the first area 29A, as shown in FIG. 8B. Thereafter, a second pattern 91B and a first pattern 91A are formed in this order and on the second area 29B.

That is, in the second operation, a second pattern 91B is formed on each area where a first pattern 91A is formed during the first operation, while a first pattern 91A is formed on each area where a second pattern 91B is formed during the first operation. Consequently, the first and second patterns 91A, 91B formed during the second operation are arranged in reverse order to those formed during the first operation, regarding the reference point P as a reference.

What is claimed is:

1. An image forming apparatus comprising:

an image carrier capable of rotation;

a forming portion configured to form a first pattern and a second pattern on said image carrier, said first pattern being used for detecting displacement of an image forming position in a rotational direction of said image carrier, said second pattern being used for detecting displacement of an image forming position in a direction perpendicular to said rotational direction;

a detecting portion configured to detect said first pattern and said second pattern formed on said image carrier; and a correcting portion configured to correct, based on a detection result from said detecting portion, an image forming position associated with said forming portion, wherein:

said forming portion performs a first operation and thereafter performs a second operation;

at least one of said first pattern and said second pattern is formed on a first area of said image carrier during said first operation, and at least the other of said first pattern and said second pattern is formed on a second area of said image carrier during said first operation, said first area corresponding to a half of said image carrier, said second area corresponding to the remaining half of said image carrier; and said first pattern is formed, during said second operation, on an area of said image carrier where said second pattern is formed during said first operation, and said second pattern is formed, during said second operation, on an area of said image carrier where said first pattern is formed during said first operation.

2. An image forming apparatus as in claim 1, wherein:

said correcting portion is capable of a single correction based on one of a first detection result obtained from said detecting portion during said first operation and a second detection result obtained from said detecting portion during said second operation, and further capable of a double correction based on both of said first detection result and said second detection result, said image forming apparatus further comprising:

a selecting portion configured to select one of said single correction and said double correction as a correction to be performed by said correcting portion.

3. An image forming apparatus as in claim 2, wherein:

said forming portion starts said first operation when an execution condition is satisfied, said image forming apparatus further comprising:

a condition changing portion configured to change said execution condition after said correcting portion performs said single correction, so that next execution of said first operation is started earlier compared to when said correcting portion has performed said double correction.

4. An image forming apparatus as in claim 2, wherein:

said selecting portion finishes a selection before said second operation is started; and said forming portion skips said second operation if said selecting portion selects said single correction that is based on said first detection result.

5. An image forming apparatus as in claim 2, wherein said selecting portion makes a selection based on an amount of colorant left for said forming portion.

6. An image forming apparatus as in claim 2, further comprising:

a collecting portion configured to collect colorant attached on said image carrier;

wherein said selecting portion makes a selection based on an amount of colorant collected by said collecting portion.

7. An image forming apparatus as in claim 2, wherein said selecting portion makes a selection based on a user's operation.

8. An image forming apparatus as in claim 2, further comprising:

a determining portion configured to determine whether a detection result from said detecting portion is normal;

wherein said correcting portion performs said single correction based on said first detection result, if said determining portion determines that said second detection result is abnormal.

* * * * *